US009976104B2

(12) United States Patent
Najman et al.

(10) Patent No.: US 9,976,104 B2
(45) **Date of Patent: *May 22, 2018**

(54) ANTIWEAR COMPOSITION AND METHOD OF LUBRICATING DRIVELINE DEVICE

(71) Applicant: The Lubrizol Corporation, Wickliffe, OH (US)

(72) Inventors: Morey N. Najman, Midland, MI (US); Mark R. Baker, Midland, MI (US); Vera M. Marsic, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/390,758

(22) Filed: Dec. 27, 2016

(65) Prior Publication Data

US 2017/0107442 A1 Apr. 20, 2017

Related U.S. Application Data

(63) Continuation of application No. 15/161,681, filed on May 23, 2016, now abandoned, which is a continuation of application No. 14/933,330, filed on Nov. 5, 2015, now abandoned, which is a continuation of application No. 14/690,588, filed on Apr. 20, 2015, now abandoned, which is a continuation of application No. 13/959,982, filed on Aug. 6, 2013, now abandoned, which is a continuation of application No. 13/390,790, filed as application No. PCT/US2010/045145 on Aug. 11, 2010, now Pat. No. 8,951,943.

(60) Provisional application No. 61/234,722, filed on Aug. 18, 2009.

(51) Int. Cl.

| | |
|---|---|
| ***C10M 139/00*** | (2006.01) |
| ***C10M 135/36*** | (2006.01) |
| ***C10M 169/04*** | (2006.01) |
| ***C10M 141/10*** | (2006.01) |

(52) U.S. Cl.

CPC .... *C10M 141/10* (2013.01); *C10M 2207/282* (2013.01); *C10M 2215/223* (2013.01); *C10M 2219/106* (2013.01); *C10M 2223/043* (2013.01); *C10M 2223/049* (2013.01); *C10N 2230/06* (2013.01); *C10N 2230/10* (2013.01); *C10N 2230/54* (2013.01); *C10N 2240/04* (2013.01)

(58) Field of Classification Search

CPC ..... C10M 2215/28; C10M 2219/106; C10M 2223/049; C10M 2223/043; C10M 2207/283

USPC ..... 508/192, 272, 273, 442, 439, 437

See application file for complete search history.

(56) References Cited

U.S. PATENT DOCUMENTS

| | | | | |
|---|---|---|---|---|
| 4,237,022 | A | 12/1980 | Barrer et al. | |
| 4,326,972 | A | 4/1982 | Chamberlin et al. | |
| 4,952,328 | A | 8/1990 | Davis et al. | |
| 5,338,470 | A | 8/1994 | Hiebert et al. | |
| 5,462,683 | A | 10/1995 | Kinoshita et al. | |
| 2005/0198894 | A1* | 9/2005 | Migdal | C10L 1/19 44/388 |
| 2006/0183647 | A1* | 8/2006 | Kocsis | C10M 129/72 508/287 |
| 2006/0276352 | A1* | 12/2006 | Vinci | C10M 163/00 508/272 |
| 2009/0036623 | A1 | 3/2009 | Najman et al. | |
| 2011/0177988 | A1 | 7/2011 | Najman et al. | |

FOREIGN PATENT DOCUMENTS

| | | |
|---|---|---|
| EP | 0781834 | 7/1997 |
| WO | 2005087904 | 9/2005 |
| WO | 2006044411 | 4/2006 |
| WO | 2007044820 | 4/2007 |
| WO | 2008070307 | 6/2008 |
| WO | 2008147700 | 12/2008 |
| WO | 2010077630 | 7/2010 |

* cited by examiner

*Primary Examiner* — Vishal Vasisth

(74) *Attorney, Agent, or Firm* — Michael A. Miller; Christopher D. Hilker

(57) ABSTRACT

The present invention relates to an antiwear agent and lubricating compositions thereof. The invention further provides for a method of lubricating a driveline device application by employing a lubricating composition containing the antiwear agent.

6 Claims, No Drawings

ANTIWEAR COMPOSITION AND METHOD OF LUBRICATING DRIVELINE DEVICE

CROSS-REFERENCE TO RELATED APPLICATION

This application is a CON of Ser. No. 15/161,681 filed May 23, 2016, now abandoned which is a CON of Ser. No. 14/933,330 filed Nov. 5, 2015, now abandoned which is a CON of Ser. No. 14/690,588 filed Apr. 20, 2015, now abandoned which is a CON of Ser. No. 13/959,982 filed Aug. 6, 2013, now abandoned which is a CON of Ser. No. 13/390,790 filed May 8, 2012, now U.S. Pat. No. 8,951,943 which is a 371 of PCT/US2010/045145 filed Aug. 11, 2010 which claims benefit of 61/234,722 filed Aug. 18, 2009.

FIELD OF INVENTION

The present invention relates to an antiwear agent and lubricating compositions thereof. The invention further provides for a method of lubricating a driveline device by employing a lubricating composition described herein.

BACKGROUND OF THE INVENTION

One of the important parameters influencing durability or wear resistance of devices employing a lubricating composition is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In addition, many of the sulphur-containing antiwear or extreme pressure additives evolve volatile sulphur species, resulting in lubricating compositions containing antiwear or extreme pressure additives having an odour, which may also be detrimental to the environment or evolve emissions that may be higher than increasingly tighter health and safety legislation specifies.

A lubricating composition having the correct balance of phosphorus antiwear or extreme pressure additives provides driveline power transmitting devices with prolonged life and efficiency with controlled deposit formation and oxidation stability. However, many of the antiwear or extreme pressure additives employed have at least one of (i) limited extreme pressure and antiwear performance over a wide range of operating conditions, (ii) limited oxidative stability, (iii) form deposits, or (iv) cause corrosion (for example copper corrosion). In addition, many phosphorus antiwear or extreme pressure additives typically contain sulphur, which results in an odorous lubricating composition containing the phosphorus antiwear or extreme pressure additives. A number of references disclosing antiwear chemistry are discussed below.

U.S. Pat. No. 5,338,470 discloses alkylated citric acid derivatives obtained as a reaction product of citric acid and an alkyl alcohol or amine. The alkylated citric acid derivative is effective as an antiwear agent and friction modifier.

U.S. Pat. No. 4,237,022 discloses tartrimides useful as additives in lubricants and fuels for effective reduction in squeal and friction as well as improvement in fuel economy.

U.S. Pat. No. 4,952,328 discloses lubricating oil compositions for internal combustion engines, comprising (A) oil of lubricating viscosity, (B) a carboxylic derivative produced by reacting a succinic acylating agent with certain amines, and (C) a basic alkali metal salt of sulphonic or carboxylic acid.

U.S. Pat. No. 4,326,972 discloses lubricant compositions for improving fuel economy of internal combustion engines. The composition includes a specific sulphurised composition (based on an ester of a carboxylic acid) and a basic alkali metal sulphonate.

International publication WO 2008/070307 discloses malonate esters suitable as antiwear agents.

International Patent application WO U.S. Ser. No. 09/036,623 (Filed Mar. 10, 2009 by Najman) discloses a driveline device lubricated with a composition containing a derivative of a hydroxycarboxylic acid and a phosphorus compound that may be either (i) a hydroxy-substituted di-ester of (thio)phosphoric acid, or (ii) a phosphorylated hydroxy-substituted di- or tri-ester of (thio)phosphoric acid.

International publication WO 2005/087904 discloses lubricants containing hydroxy carboxylic acid and hydroxy polycarboxylic acid esters in combination with phosphorus-containing additives. The phosphorus-containing additives include zinc dihydrocarbyldithiophosphates and/or neutral phosphorus compounds, such as trilauryl phosphate or triphenylphosphorothionate. The lubricants are useful in engine lubricants.

International publication WO 2006/044411 discloses a low-sulphur, low-phosphorus, low-ash lubricant composition containing a tartrate ester, or amide having 1 to 150 carbon atoms per ester or amide group. The lubricant composition is suitable for lubricating an internal combustion engine.

SUMMARY OF THE INVENTION

The inventors of this invention have discovered that a lubricating composition and method as disclosed herein is capable of providing acceptable levels of at least one of (i) sulphur (typically reducing or preventing emissions from waste oil), (ii) fuel economy/efficiency (typically improving fuel economy/efficiency), (iii) oxidation control (typically reducing or preventing oxidation), (iv) friction performance, (v) wear and/or extreme pressure performance (typically reducing or preventing wear), and (vi) deposit control. Wear may include reduced rippling, ridging and scoring. The wear may be observed on a ring and/or pinion of a driveline device.

In one embodiment the invention provides a lubricating composition comprising an oil of lubricating viscosity and an antiwear package, wherein the antiwear package comprises (a) a derivative of a hydroxycarboxylic acid, and (b) a phosphorus compound selected from the group consisting of an amine salt of a phosphate hydrocarbon ester, a phosphite having at least one hydrocarbyl group with 4 or more carbon atoms, and mixtures thereof. In one embodiment the phosphorus compound is a mixture of an amine salt of a phosphate hydrocarbon ester, and a phosphite having at least one hydrocarbyl group with 4 or more carbon atoms.

In one embodiment the invention provides a method for lubricating a driveline device comprising supplying to the driveline device a lubricating composition comprising an oil of lubricating viscosity and an antiwear package wherein the antiwear package comprises (a) a derivative of a hydroxycarboxylic acid, and (b) a phosphorus compound selected from the group consisting of an amine salt of a phosphate hydrocarbon ester, a phosphite having at least one hydrocarbyl group with 4 or more carbon atoms, having at least one hydrocarbyl group with 4 or more carbon atoms, and mixtures thereof.

In one embodiment the derivatives of hydroxycarboxylic acid include imides, di-esters, di-amides, ester-amides derivatives of tartaric acid.

In one embodiment the phosphorus compound may be an amine salt of a phosphate hydrocarbon ester, or mixtures thereof.

In one embodiment the lubricating composition disclosed herein contains (a) the derivative of a hydroxycarboxylic acid present at 0.01 wt % to 3 wt %, or 0.01 wt % to 1 wt %, or 0.05 wt % to 0.5 wt %, or 0.1 wt % to 0.2 wt % (typically 0.05 wt % to 0.5 wt %) of the lubricating composition; and (b) the phosphorus compound present at 0.01 wt % to 5 wt %, or 0.05 wt % to 2 wt %, or 0.1 wt % to 1 wt %, or 0.2 wt % to 0.4 wt % (typically 0.1 wt % to 1 wt %) of the lubricating composition.

In different embodiments the lubricating compositions disclosed herein contain 0 ppm to 500 ppm, or 5 ppm to 300 ppm, or 20 ppm to 250 ppm of molybdenum.

In different embodiments the lubricating compositions disclosed herein may have a sulphur-content of greater than 0.3 wt %, or 0.4 wt % to 5 wt %, or 0.5 wt % to 3 wt %, 0.8 wt % to 2.5 wt %, or 1 wt % to 2 wt % of the lubricating composition.

In one embodiment the invention provides for the use of a lubricating composition as disclosed herein for providing acceptable levels of at least one of (i) phosphorus emissions, (ii) sulphur emissions, (iii) fuel economy/efficiency, (iv) oxidation control, (v) friction performance, (vi) wear and/or extreme pressure performance (typically wear reducing or preventing), and (vii) deposit control.

DETAILED DESCRIPTION OF THE INVENTION

The present invention provides a lubricating composition; and a method for lubricating a driveline device as disclosed above.

Compound Derived from Hydroxy-Carboxylic Acid

The invention provides a lubricating composition containing a compound derived from a hydroxy-carboxylic acid. The compound derived from a hydroxy-carboxylic acid may be represented by the formula:

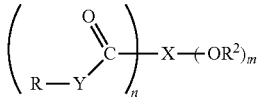

wherein n and m may be independently integers of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment;

each Y may be independently —O—, or $>NR^1$ or two Ys together may represent the nitrogen of an imide structure R—N<formed between two carbonyl groups; and each R and $R^1$ may be independently hydrogen or a hydrocarbyl group, provided that at least one R or $R^1$ group is a hydrocarbyl group; each $R^2$ may be independently hydrogen, a hydrocarbyl group or an acyl group, further provided that at least one $—OR^2$ group is located on a carbon atom within X that is α or β to at least one of the —C(O)—Y—R groups.

The compound derived from the hydroxy-carboxylic acid may be derived from glycolic acid (n and m both equal 1), malic acid (n=2, m=1), tartaric acid (n and m both equal 2), citric acid (n=3, m=1), or mixtures thereof. In one embodiment the compound derived from the hydroxy-carboxylic acid may be derived from tartaric acid or citric acid. In one embodiment the compound derived from the hydroxy-carboxylic acid may be derived from tartaric acid.

The compound derived from the hydroxy-carboxylic acid may be an amide, ester or imide derivative of a hydroxy-carboxylic acid, or mixtures thereof. In one embodiment the compound derived from the hydroxy-carboxylic acid may be an amide, ester or imide derivative of a hydroxy-carboxylic acid. For example the compound derived from the hydroxy-carboxylic acid may an ester or imide of tartaric acid, or the compound derived from the hydroxy-carboxylic acid may an ester or imide of citric acid.

In one embodiment the compound derived from the hydroxy-carboxylic acid may be at least one of a hydroxy-carboxylic acid di-ester, a hydroxy-carboxylic acid di-amide, a hydroxy-carboxylic acid di-imide, a hydroxy-carboxylic acid mono-imide, a hydroxy-carboxylic acid ester-amide, a hydroxy-carboxylic acid ester-imide, and a hydroxy-carboxylic acid imide-amide. In one embodiment the amide, ester or imide derivative of a hydroxy-carboxylic acid may derived from at least one of the group consisting of a hydroxy-carboxylic acid di-ester, a hydroxy-carboxylic acid di-amide, a hydroxy-carboxylic acid mono-imide, and a hydroxy-carboxylic acid ester-amide.

Each R, $R^1$ and $R^2$ group of the compound derived from the hydroxy-carboxylic acid may be a linear or branched alkyl group each having 1 to 150, or 8 to 30, or 8 to 20 carbon atoms. The ester derivatives of the hydroxy-carboxylic acid may be formed by the reaction of an alcohol with hydroxy-carboxylic acid. The alcohol includes both monohydric alcohols and polyhydric alcohols. The carbon atoms of the alcohol may be linear chains, branched chains, or mixtures thereof.

Examples of a suitable branched alcohol include 2-ethylhexanol, iso-tridecanol, iso-octyl alcohol, Guerbet alcohols, or mixtures thereof.

Examples of a monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 8 to 20 carbon atoms.

In one embodiment the imide derivatives of a hydroxy-carboxylic acid may be tartrimides, typically containing 8 to 20 carbon atoms. Amines used to prepare imides may include alkyl amines (such as n-hexylamine (caproylamine), n-octylamine (caprylylamine), n-decylamine (caprylamine), n-dodecyl amine (laurylamine), n-tetradecylamine (myristylamine), n-pentadecyl amine, n-hexadecylamine (palmitylamine), margarylamine, n-octadecylamine (stearylamine)), unsaturated amines (such as dodecenylamine, myristoleylamine, palmitoleylamine, oleylamine, and linoleylamine), or etheramines (such as those identified as SURFAM™ P14AB (branched C14), SURFAM™ P16A (linear C16), and SURFAM™ P17AB (branched C17)). A detailed description of methods for preparing suitable tartrimides (by reacting tartaric acid with a primary amine) is disclosed in U.S. Pat. No. 4,237,022.

U.S. Patent Applications U.S. 60/939,949 (filed May 24, 2007) and U.S. 60/939,952 (filed May 24, 2007) disclose in more detail useful hydroxycarboxylic acid compounds for the present invention.

Canadian Patent 1 183 125; US Patent Publication numbers 2006/0183647 and US-2006-0079413; U.S. Patent Application No. 60/867,402; and British Patent 2 105 743 A, all disclose useful examples of suitable tartaric acid derivatives.

The compound derived from the hydroxy-carboxylic acid may be present at 0.01 wt % to 3 wt %, or 0.01 wt % to 1 wt %, or 0.05 wt % to 0.5 wt %, or 0.1 wt % to 0.2 wt % of the lubricating composition.

Phosphorus Compound

The phosphorus compound may be selected from the group consisting of an amine salt of a phosphate hydrocarbon ester, a phosphite having at least one hydrocarbyl group with 4 or more carbon atoms, having at least one hydrocarbyl group with 4 or more carbon atoms, and mixtures thereof.

In one embodiment the phosphorus compound is sulphur-free i.e., the phosphorus compound is not a thiophosphite, nor a thiophosphate.

The phosphorus compound may be present at 0.01 wt % to 5 wt %, or 0.05 wt % to 2 wt %, or 0.1 wt % to 1 wt %, or 0.2 wt % to 0.4 wt % of the lubricating composition. The amount of phosphorus provided to the lubricating composition by the phosphorus compound may, in certain embodiments, be 0.001 to 0.5 wt %, or 0.005 to 0.2 wt %, or 0.01 to 0.1 wt % or 0.02 to 0.04 wt %.

Amine Salt of a Phosphate Hydrocarbon Ester

In one embodiment the lubricating composition contains a phosphorus compound that may be an amine salt of a phosphate hydrocarbon ester (i.e., an amine salt of a hydrocarbon ester of phosphoric acid). The amine salt of a phosphate hydrocarbon ester may be derived from an amine salt of a phosphate. The amine salt of the phosphate hydrocarbon ester may be represented by the formula:

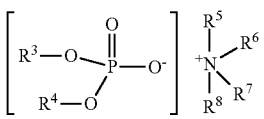

wherein $R^3$ and $R^4$ may be independently hydrogen or hydrocarbon typically containing 4 to 40, or 6 to 30, or 6 to 18, or 8 to 18 carbon atoms, with the proviso that at least one is a hydrocarbon group; and $R^5$, $R^6$, $R^7$ and $R^8$ may be independently hydrogen or a hydrocarbyl group, with the proviso that at least one is a hydrocarbyl group.

The hydrocarbon groups of $R^3$ and/or $R^4$ may be linear, branched, or cyclic.

Examples of a hydrocarbon group for $R^3$ and/or $R^4$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^3$ and/or $R^4$ include cyclopentyl, cyclohexyl, cycloheptyl, methylcyclopentyl, dimethylcyclopentyl, methylcyclopentyl, dimethylcyclopentyl, methylethylcyclopentyl, diethyl-cyclopentyl, methylcyclohexyl, dimethylcyclohexyl, methylethylcyclohexyl, diethylcyclohexyl, methylcycloheptyl, dimethylcycloheptyl, methylethyl-cycloheptyl, and diethylcycloheptyl.

In one embodiment the phosphate may be an amine salt of a mixture of monoalkyl and dialkyl phosphoric acid esters. The monoalkyl and dialkyl groups may be linear or branched.

The amine salt of a phosphate hydrocarbon ester may be derived from an amine such as a primary amine, a secondary amine, a tertiary amine, or mixtures thereof. The amine may be aliphatic, or cyclic, aromatic or non-aromatic, typically aliphatic. In one embodiment the amine includes an aliphatic amine such as a tertiary-aliphatic primary amine.

Examples of suitable primary amines include ethylamine, propyl amine, butylamine, 2-ethylhexylamine, bis-(2-ethylhexyl)amine, octylamine, and dodecylamine, as well as such fatty amines as n-octylamine, n-decylamine, n-dodecyl amine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen H T, Armeen S and Armeen S D, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment the amines are in the form of a mixture. Examples of suitable mixtures of amines include (i) a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butyl amine, tert-hexyl amine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanyl amine, and tert-octacosanylamine.

In one embodiment a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphate hydrocarbon ester may be prepared as is described in U.S. Pat. No. 6,468,946. Column 10, lines 15 to 63 describes phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphate hydrocarbon ester.

Phosphite

In one embodiment the lubricating composition contains a phosphite having at least one hydrocarbyl group with 4 or more carbon atoms. In one embodiment the lubricating composition contains a phosphite having at least one hydrocarbyl group with 8 or more, or 12 or more carbon atoms. Typical ranges for the number of carbon atoms on the hydrocarbyl group include 4 to 30, or 10 to 24, or 12 to 22, or 14 to 20, or 16 to 18. The phosphite may be a monohydrocarbyl substituted phosphite, a di-hydrocarbyl substituted phosphite, or a tri-hydrocarbyl substituted phosphite.

The phosphite having at least one hydrocarbyl group with 4 or more carbon atoms may be represented by the formulae:

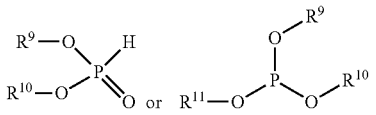

wherein at least one or two of $R^9$, $R^{10}$ and $R^{11}$ may be a hydrocarbyl group containing at least 4 carbon atoms and the other may be hydrogen or a hydrocarbyl group. In one embodiment two or more of $R^9$, $R^{10}$ and $R^{11}$ are hydrocarbyl groups. The hydrocarbyl groups may be alkyl, cycloalkyl, aryl, acyclic or mixtures thereof. In the formula with all three groups $R^9$, $R^{10}$ and $R^{11}$, the compound may be a tri-hydrocarbyl substituted phosphite i.e., $R^9$, $R^{10}$ and $R^{11}$ are all hydrocarbyl groups.

Alkyl groups may be linear or branched, typically linear, and saturated or unsaturated, typically saturated. Examples of alkyl groups for $R^9$, $R^{10}$ and $R^{11}$ include butyl, hexyl, octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof.

Alkyl groups may be linear or branched, typically linear, and saturated or unsaturated, typically saturated. Examples of alkyl groups for $R^9$, $R^{10}$ and $R^{11}$ include butyl, hexyl, octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof. In one embodiment the alkyl groups $R^9$ and $R^{10}$ have 4 carbon atoms (typically n-butyl).

The amine salt of a phosphate hydrocarbon ester and/or, a phosphite having at least one hydrocarbyl group with 4 or more carbon atoms may in one embodiment be in a mixture with one or more of phosphorus acid, phosphoric acid, polyphosphoric acid, a trialkyl phosphate or trialkyl thiophosphate. For instance the amine salt of a phosphate hydrocarbon ester and/or, a phosphite having at least one hydrocarbyl group with 4 or more carbon atoms may in one embodiment be in a mixture with phosphoric acid.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Catagories". In one embodiment the oil of lubricating viscosity may be an API Group I, or Group II, or Group III, or Group IV oil. In one embodiment the oil of lubricating viscosity may be an API Group II or Group III oil. In one embodiment the oil of lubricating viscosity may be a hydrocracked or severely hydrocracked base stock and/or an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Organo-Sulphide

In one embodiment the lubricating composition further comprises an organo-sulphide, or mixtures thereof. In one embodiment the organo-sulphide comprises at least one of a polysulphide, thiadiazole compound, or mixtures thereof.

In different embodiments, the organo-sulphide is present in a range selected from the group consisting of 0 wt % to 10 wt %, 0.01 wt % to 10 wt %, 0.1 wt % to 8 wt %, and 0.25 wt % to 6 wt %; of the lubricating composition.

Thiadiazole Compound

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. These thiadiazole compounds may also be used in the post treatment of dispersants as mentioned below in the formation of a dimercaptothiadiazole derivative of a polyisobutylene succinimide.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10.

In one embodiment, the thiadiazole compound is the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

Polysulphide

In one embodiment at least 50 wt % of the polysulphide molecules are a mixture of tri- or tetra-sulphides. In other embodiments at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerising by known techniques, an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

Friction Modifier

In one embodiment the lubricating composition further comprises a friction modifier. In different embodiments, the friction modifier is present in a range selected from the group consisting of 0 wt % to 5 wt %, 0.1 wt % to 4 wt %, 0.25 wt % to 3.5 wt %, 0.5 wt % to 2.5 wt %, and 1 wt % to 2.5 wt %, or 0.05 wt % to 0.5 wt % of the lubricating composition.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment the friction modifier includes a fatty acid ester of glycerol. The final product may be in the form of a metal salt, an amide, an imidazoline, or mixtures thereof. The fatty acids may contain 6 to 24, or 8 to 18 carbon atoms. The fatty acids may branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid is oleic acid. When in the form of a metal salt, typically the metal includes zinc or calcium; and the products include overbased and non-overbased products. Examples are overbased calcium salts and basic oleic acid-zinc salt complexes which can be represented by the general formula $Zn_4Oleate_6O$. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier is the condensation product of a fatty acid with C8 to C24 atoms, and a polyalkylene polyamine, and in particular, the product of isostearic acid with tetraethylenepentamine.

In one embodiment the friction modifier includes those formed by the condensation of the hydroxyalkyl compound with an acylating agent or an amine. A more detailed description of the hydroxyalkyl compound is described in WO 2007/0044820 paragraphs 9, and 20-22. The friction modifier disclosed in WO2007/044820 includes an amide represented by the formula $R^{12}R^{13}N—C(O)R^{14}$, wherein $R^{12}$ and $R^{13}$ are each independently hydrocarbyl groups of at least 6 carbon atoms and $R^{14}$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 72 and 73 of WO2007/044820). In one embodiment the amide of a hydroxylalkyl compound is prepared by reacting glycolic acid, that is, hydroxyacetic acid, $HO—CH_2—COOH$ with an amine.

In one embodiment the friction modifier includes a secondary or tertiary amine being represented by the formula $R^{15}R^{16}NR^{17}$, wherein $R^{15}$ and $R^{16}$ are each independently an alkyl group of at least 6 carbon atoms and $R^{17}$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment the friction modifier includes a reaction product of a di-cocoalkyl amine (or di-cocoamine) with glycolic acid. The friction modifier includes compounds prepared in Preparative Examples 1 and 2 of WO 2008/014319.

In one embodiment the friction modifier includes those derived from the reaction product of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in US Patent Application 2003/22000 (or International Publication WO04/007652) in paragraphs 8 and 9 to 14.

In one embodiment the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier includes a hydroxyl amine compound as defined in column 37, line 19, to column 39, line 38 of U.S. Pat. No. 5,534,170. Optionally the hydroxyl amine includes borated as such products are described in column 39, line 39 to column 40 line 8 of U.S. Pat. No. 5,534,170.

In one embodiment the friction modifier includes an alkoxylated amine e.g., an ethoxylated amine derived from 1.8% Ethomeen™ T-12 and 0.90% Tomah™ PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10] cocoamine); ETHOMEEN™ S/12 (bis[2-hydroxyethyl] soyamine); ETHOMEEN™ T/12 (bis[2-hydroxyethyl] allow-amine); ETHOMEEN™ T/15 (polyoxyethylene-[5] tallowamine); ETHOMEEN™ 0/12 (bis[2-hydroxyethyl] oleyl-amine); ETHOMEEN™ 18/12 (bis[2-hydroxyethyl] octadecylamine); and ETHOMEEN™ 18/25 (polyoxyethylene[15]octadecylamine). Fatty amines and ethoxylated fatty amines are also described in U.S. Pat. No. 4,741,848.

In one embodiment the friction modifier includes a polyol ester as described in U.S. Pat. No. 5,750,476 column 8, line 40 to column 9, line 28.

In one embodiment the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment the friction modifier includes a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment the friction modifier includes an alkylphosphonate mono- or di-ester sold commercially by Rhodia under the trademark Duraphos® DMODP.

In one embodiment the friction modifier includes a borated fatty epoxide or alkylene oxide, known from Canadian Patent No. 1,188,704. These oil-soluble boron-containing compositions are prepared by reacting, at a temperature of 80° C. to 250° C., boric acid or boron trioxide with at least one fatty epoxide or alkylene oxide. The fatty epoxide or alkylene oxide typically contains at least 8 carbon atoms in the fatty groups of the epoxide (or the alkylene groups of the alkylene oxide).

The borated fatty epoxides include those characterised by the method for their preparation which involves the reaction of two materials. Reagent A includes boron trioxide or any of the various forms of boric acid including metaboric acid ($HBO_2$), orthoboric acid ($H_3BO_3$) and tetraboric acid ($H_2B_4O_7$), or orthoboric acid. Reagent B includes at least one fatty epoxide. The molar ratio of reagent A to reagent B is generally 1:0.25 to 1:4, or 1:1 to 1:3, or 1:1 to 1:2. The borated fatty epoxides includes compounds prepared by blending the two reagents and heating them at temperature of 80° C. to 250° C., or 100° C. to 200° C., for a period of time sufficient for reaction to take place. If desired, the reaction may be effected in the presence of a substantially inert, normally liquid organic diluent. During the reaction, water is evolved and may be removed by distillation.

Other Performance Additive

The composition of the invention optionally further includes at least one other performance additive. The other performance additives include metal deactivators, detergents, dispersants, viscosity modifiers, dispersant viscosity modifiers, antioxidants, corrosion inhibitors, foam inhibitors, demulsifiers, pour point depressants, seal swelling agents, and mixtures thereof.

In different embodiments, the total combined amount of the other performance additive compounds is present in a range selected from the group consisting of 0 wt % to 25 wt %, 0.1 wt % to 15 wt %, and 0.5 wt % to 10 wt %, of the lubricating composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds such as alkylated diphenylamines (typically di-nonyl diphenylamine, octyl diphenyl amine, or di-octyl diphenyl amine).

Detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a di-thiophosphoric acid, a saligenin, an alkylsalicylate, and a salixarate.

Dispersants are known and include for example an N-substituted long chain alkenyl succinimide, a Mannich base, or mixtures thereof. Examples of N-substituted long chain alkenyl succinimides include polyisobutylene succinimide, wherein the polyisobutylene from which the polyisobutylene succinic anhydride is derived has a number average molecular weight in the range of 350 to 5000, or 500 to 3000, or 750 to 1150.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant may be a borated dispersant such as a borated polyisobutylene succinimide. In one embodiment the post-treated dispersant may be made by reaction with a dimercaptothiadiazole (to form a dispersant such as a dimercaptothiadiazole derivative of a polyisobutylene succinimide).

In different embodiments, the dispersant is present in a range selected from the group consisting of 0 wt % to 10 wt %, 0.01 wt % to 10 wt %, and 0.1 wt % to 5 wt %, of the lubricating composition.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. Dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrene-maleic anhydride copolymers reacted with an amine; may also be used in the composition of the invention.

Corrosion inhibitors include octylamine octanoate, condensation products of dodecenyl succinic acid or anhydride and a fatty acid such as oleic acid with a polyamine, or a thiadiazole compound described above. Metal deactivators include derivatives of benzotriazoles (typically tolyltriazole), 1,2,4-triazoles, benzimidazoles, 2-alkyldithiobenzimidazoles or 2-alkyldithiobenzothiazoles.

Foam inhibitors include for example copolymers of ethyl acrylate and 2-ethylhexylacrylate and optionally vinyl acetate. Demulsifiers include trialkyl phosphates, polyethylene glycols, polyethylene oxides, polypropylene oxides and (ethylene oxide-propylene oxide) polymers. Pour point depressants include esters of maleic anhydride-styrene, polymethacrylates, polyacrylates or polyacrylamides. Seal swell agents include Exxon Necton-37™ (FN 1380) and Exxon Mineral Seal Oil (FN 3200).

INDUSTRIAL APPLICATION

The method of the invention is useful for lubricating a variety of driveline devices applications. The driveline device comprises at least one of a gear, a gearbox, an axle gear, a traction drive transmission, an automatic transmission or a manual transmission. In one embodiment the driveline device is a manual transmission or a gear, a gearbox, or an axle gear.

The automatic transmission includes continuously variable transmissions (CVT), infinitely variable transmissions (IVT), Torroidal transmissions, continuously slipping torque converted clutches (CSTCC), stepped automatic transmissions or dual clutch transmissions (DCT).

In one embodiment the invention provides for the use of the lubricating composition disclosed herein in gears and transmissions to impart at least one of antiwear performance, extreme pressure performance, acceptable deposit control, acceptable oxidation stability and reduced odour.

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

The following examples provide illustrations of the invention. These examples are non-exhaustive and are not intended to limit the scope of the invention.

Examples

Lubricant Example 1 (EX1) is a 80W-90 gear oil lubricant containing 0.4 wt % of a Primene®81-R amine salt of oleyl phosphate and 0.15 wt % of 2-ethylhexyl tartrate.

Comparative Lubricant Example 1 (CLE1) is a gear oil lubricant similar to EX1, except it does not contain the tartrate.

Lubricant Example 2 (EX2) is a 80W-90 gear oil lubricant containing 0.4 wt % of a dibutyl phosphite and 0.15 wt % of 2-ethylhexyl tartrate.

Comparative Lubricant Example 2 (CLE2) is a gear oil lubricant similar to EX2, except it does not contain the tartrate.

Comparative Lubricant Example 3 (CLE3) is a gear oil lubricant similar to EX1, except it contains 0.15 wt % of 2-ethyl hexyl tartrate and 0.18 wt % of an amine salt of a thiophosphate as described by preparative examples 6 to 8 of International Patent application WO U.S. Ser. No. 09/036,623 as described in paragraph [0107] of said application.

Comparative Lubricant Example 4 (CLE4) is a gear oil lubricant similar to EX1, except contains 0.18 wt % of an amine salt of a phosphate as described by preparative examples 1 to 4 of International Patent application WO U.S. Ser. No. 09/036,623 as described in paragraphs [0099] to [0105] of said application.

Lubricant Example 3 (EX3) is an 80W-90 gear oil lubricant containing 1 wt % of a Primene®81-R amine salt of oleyl phosphate, 0.25 wt % of dibutyl phosphite, and 0.1 wt % of 2-ethylhexyl tartrate.

Lubricant Example 4 (EX4) is a 75W-90 gear oil lubricant containing 0.8 wt % of a Primene®81-R amine salt of oleyl phosphate, 0.5 wt % of dibutyl phosphite, and 0.2 wt % of 2-ethylhexyl tartrate.

Lubricants CLE1 to CLE4 and EX1 to EX4 are evaluated by the methodologies of ASTM D6121-05a (the L-37 Gear Durability Test), and L-42 Axle Shock Test method described in ASTM publication STP 512A. Typically better results in the L-42 test are for samples with lower percent rating of ring and pinion scoring. Typically, better results in the L-37 test are obtained for samples with higher numbers.

The results obtained for EX1 and comparative examples CLE1, CLE3 and CLE4 at the end of the L-42 test are as follows:

| | Ring Drive | Ring Coast | Pinion Drive | Pinion Coast |
|---|---|---|---|---|
| EX1 | 0 | 13 | 0 | 17 |
| CLE1 | 0 | 21 | 0 | 29 |
| CLE3 | 0 | 57 | 0 | 34 |
| CLE4 | 0 | 92 | 0 | 66 |

The results of the L-42 test indicate that the composition of the invention has reduced ring and pinion scoring compared to similar compositions containing other antiwear additives. For example the lubricating composition disclosed herein has improved performance in the L-42 test over compositions similar to those disclosed in International Patent application WO U.S. Ser. No. 09/036,623 (i.e., CLE3 and CLE4).

The results obtained for EX1 and comparative example CLE1 at the end of the L-37 test are as follows:

| Parameter Rated on Ring | EX1 | CLE1 |
|---|---|---|
| Ring Wear | | |
| Final Wear Rating | 8 | 7 |
| Final Surface Fatigue Rippling | 10 | 9 |
| Final Surface Fatigue Ridging | 10 | 7 |
| Final Surface Fatigue Pitting and Spalling Merit | 9.9 | 9.9 |
| Final Surface Fatigue Scoring | 10 | 10 |
| Pinion Wear | | |
| Final Wear Rating | 8 | 6 |
| Final Wear Rippling | 9 | 8 |
| Final Wear Ridging | 10 | 7 |
| Final Wear Scoring | 9.9 | 9.6 |
| Final Pitting and Spalling Merit | 10 | 10 |

The results of the L-37 test indicate that the composition of the invention has reduced wear, rippling, ridging and scoring compared to similar compositions containing other antiwear phosphorus additives.

Overall, the compositions of the invention have performance benefits over comparative examples in least one of (i) sulphur (typically reducing or preventing emissions from waste oil), (ii) fuel economy/efficiency (typically improving fuel economy/efficiency), (iii) oxidation control (typically reducing or preventing oxidation), (iv) friction performance, (v) wear and/or extreme pressure performance (typically reducing or preventing), and (vi) deposit control.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

As used herein the term "fatty" as in fatty acid (and other expressions used herein) includes a hydrocarbyl chain containing 4 to 150, or 4 to 30, or 6 to 16 carbon atoms.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for lubricating a driveline device comprising supplying to the driveline device a lubricating composition comprising an oil of lubricating viscosity and an antiwear package wherein the antiwear package comprises (a) 0.05 wt % to 0.5 wt % of a derivative of a hydroxycarboxylic acid, wherein the derivative of a hydroxycarboxylic acid is represented by the formula:

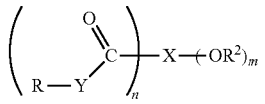

wherein n=2, m=1, or n and m both equal 2, or n=3, m=1;

X is an aliphatic or alicyclic group, said group containing up to 6 carbon atoms and having n+m available points of attachment;

each Y is —O—; and each R is independently hydrogen or a hydrocarbyl group, provided that at least one R group is a hydrocarbyl group; each $R^2$ is independently hydrogen, a hydrocarbyl group, further provided that at least one —$OR^2$ group is located on a carbon atom within X that is α or β to at least one of the —C(O)—Y—R groups, and (b) 0.1 wt % to 0.5 wt % of a phosphorus compound, wherein the phosphorus compound is an amine salt of a phosphate hydrocarbon ester represented by the formula:

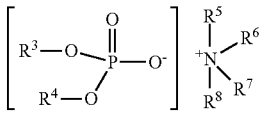

wherein $R^3$ and $R^4$ are independently hydrogen or hydrocarbon containing 4 to 40 carbon atoms, with the proviso that at least one is a hydrocarbon group; and $R^5$, $R^6$, $R^7$ and $R^8$ independently hydrogen or a hydrocarbyl group, with the proviso that at least one is a hydrocarbyl group.

2. The method of claim 1, wherein the hydroxy-carboxylic acid is tartaric acid or citric acid.

3. The method of claim 1, wherein the hydroxy-carboxylic acid is present at 0.1 wt % to 0.2 wt % of the lubricating composition.

4. The method of claim 1, wherein the phosphorus compound is present at 0.2 wt % to 0.4 wt % of the lubricating composition.

5. The method of claim 1 further comprising an organo-sulphide, wherein the organo-sulphide comprises at least one of a polysulphide, a thiadiazole compound, or mixtures thereof.

6. The method of claim 1 further comprising a borated polyisobutylene succinimide, or a dimercaptothiadiazole derivative of a polyisobutylene succinimide.

* * * * *